US005330119A

United States Patent [19]

Rodriguez et al.

[11] Patent Number: 5,330,119

[45] Date of Patent: Jul. 19, 1994

[54] AUTOMATED UNCOILING APPARATUS

[75] Inventors: Jose L. Rodriguez, Adrian, Mich.; Robert W. Sampico, Monclova; Jeffrey A. Quate, Bowling Green, both of Ohio

[73] Assignee: Abbey Etna Machine Company, Perrysburg, Ohio

[21] Appl. No.: 929,766

[22] Filed: Aug. 12, 1992

[51] Int. Cl.[5] ..... B65H 19/10; B21C 47/16

[52] U.S. Cl. ..... 242/559.2; 242/560.1; 242/562; 242/564.5

[58] Field of Search ..... 242/58, 58.1, 58.2, 242/58.3, 58.4, 58.6, 78.8, 55, 195, 76, 78.6, 78.7, 79, 80; 226/91, 92; 72/183

[56] References Cited

U.S. PATENT DOCUMENTS

| | | | |
|---|---|---|---|
| 2,683,570 | 7/1954 | Ferm | 242/78.8 |
| 2,714,917 | 8/1955 | Siegerist . | |
| 3,150,706 | 9/1964 | O'Brien . | |
| 3,343,393 | 9/1967 | Groll . | |
| 3,519,218 | 7/1970 | Mees | 242/195 X |
| 3,635,417 | 1/1972 | Kajiwara et al. | 242/78.8 |
| 3,686,921 | 8/1972 | Roper . | |
| 3,834,204 | 9/1974 | Ihle . | |
| 4,214,467 | 7/1980 | Sankaran | 242/78.8 X |
| 4,669,686 | 6/1987 | Huber et al. | 242/75.4 |
| 4,984,750 | 1/1991 | Shigeta et al. | 242/58.1 |

FOREIGN PATENT DOCUMENTS

| | | | |
|---|---|---|---|
| 58-38608 | 3/1983 | Japan | 242/78.6 |

*Primary Examiner*—John M. Jillions
*Attorney, Agent, or Firm*—Marshall & Melhorn

[57] ABSTRACT

A method and apparatus for simultaneously preparing and feeding coils of strip stock into a strip processing line. Two coil support mechanisms are provided, each rotatably supporting a coil for uncoiling. A takeoff mechanism spaced apart from the strip processing line is adapted to peel a free leading end of the strip stock from a coil. The leading end is fed to a holding mechanism adapted to receive and hold the leading end in a predetermined position. A transfer mechanism is provided for successively transferring each coil support mechanism and associated holding mechanism from the takeoff mechanism to an aligning mechanism adjacent the processing line and back to the takeoff mechanism. The strip stock is moved by pinch rollers from the holding mechanism, through the aligning mechanism, and into the processing line. One coil may be prepared for feeding in the takeoff mechanism while the other coil is being fed into the processing line.

29 Claims, 7 Drawing Sheets

AUTOMATED UNCOILING APPARATUS

BACKGROUND OF THE INVENTION

1. Field of the Invention

This invention relates to a method and apparatus for use in conjunction with processing lines for strip material and, more particularly, to a method and apparatus for feeding coils of strip stock successively into a strip processing line in rapid succession.

2. Description of the Prior Art

In accordance with a well-known tube forming process, metal strip material is supplied to mills which produce continuous welded-seam metal tubes or pipes therefrom. The strip material is transported in coil form, with individual metal coils being bound by metal straps. Apparatus is known for uncoiling the strip material or skelp, and feeding the strip into the initial section of the mill feed line.

In continuous-tube mills, the lead end of each successive strip is joined to the tail end of the preceding strip before undergoing processing. It is obviously important in the operation of such continuous-tube mills to minimize the interval between the time when one coil is stripped off into the mill feed line and the time when the subsequent coil can be fed into the mill feed line and joined to the preceding strip.

It is known to utilize two arbors mounted on a horizontal turntable, with each arbor designed to support a metal coil. A first metal coil is mounted on a first arbor positioned adjacent an uncoiling apparatus, whereby the metal strip may be paid off from the arbor directly into the strip preparing portion of the mill feed line. The second arbor is positioned away from the uncoiling apparatus, in a loading position, where an operator may mount a second metal coil onto the second arbor.

When the first metal coil has been completely stripped off the first arbor, the turntable is rotated to a position where the second metal coil may be unstrapped, manually aligned, and fed into the strip preparation portion of the mill feed line. Simultaneously, the first arbor is moved to the loading position where a third metal coil may be mounted on the arbor. Thus, the mounting activity can occur simultaneously with the unstrapping, alignment, and feeding operations.

This apparatus has not proved entirely satisfactory in that after the metal coil is rotated into position in the uncoiling apparatus, it is not immediately ready to be fed into the strip preparation portion of the mill feed line, but rather must be unstrapped and aligned.

SUMMARY OF THE INVENTION

Coils of strip stock are supported by respective support mechanisms mounted on a turntable. When a first support mechanism is positioned in a takeoff position adjacent a takeoff mechanism, a second support mechanism will be positioned in a feeding position adjacent an aligning mechanism at the end of a strip processing line. Each support mechanism may be successively positioned in the takeoff position and the feeding position. Pinch roll assemblies are mounted adjacent each support mechanisms on the turntable.

The takeoff mechanism is adapted to uncoil a lead portion of strip stock from the coil on the support mechanism in the takeoff position, and feed the lead portion into the associated pinch roll assembly. The pinch roll assembly secures the lead portion of the strip in a predetermined position while the turntable is rotated to move the first support mechanism from the takeoff position to the feeding position, and the second support mechanism to the takeoff position.

The coil supported in the feeding position is fed into the strip processing line simultaneously with the coil supported in the takeoff position being prepared in the takeoff position. Movement of the turntable is blocked until the coil on the second support mechanism has been completely fed into the strip processing line.

In the feeding position, the pinch roll assembly drives the lead portion of strip from the coil on the first support mechanism through the aligning mechanisms and into the end of a strip processing line. In the strip processing line, the lead portion is butt welded to the trailing edge of the strip which had previously been fed into the strip processing line from the coil supported by the second support mechanism. Thus a continuous length of strip is fed into the tube forming section of the strip processing line.

Simultaneously with the feeding of the coil supported on the first support mechanism into the strip processing line, a new coil of strip is loaded onto the second support mechanism. The takeoff mechanism is then operated to prepare the strip as before.

In accordance with the present invention, there is provided a method and apparatus which will permit a coil of strip to be mounted, unstrapped, and pre-aligned prior to being positioned for feeding into a strip processing line.

It is a further object of the present invention to provide an apparatus which will uncoil the strip, align it, and feed it into the strip processing line automatically.

It is also an object of the present invention to provide means for preventing the uncontrolled uncoiling of a coil which has been fed into the strip processing line if the strip manipulating devices must be loosened for any reason, such as to permit camber adjustment of a strip in order to join it to the preceding strip.

BRIEF DESCRIPTION OF THE DRAWINGS

The above, as well as other advantages of the present invention, will become readily apparent to those skilled in the art from the following detailed description of a preferred embodiment when considered in the light of the accompanying drawings, in which.

DESCRIPTION OF THE PREFERRED EMBODIMENT

Figure 1:
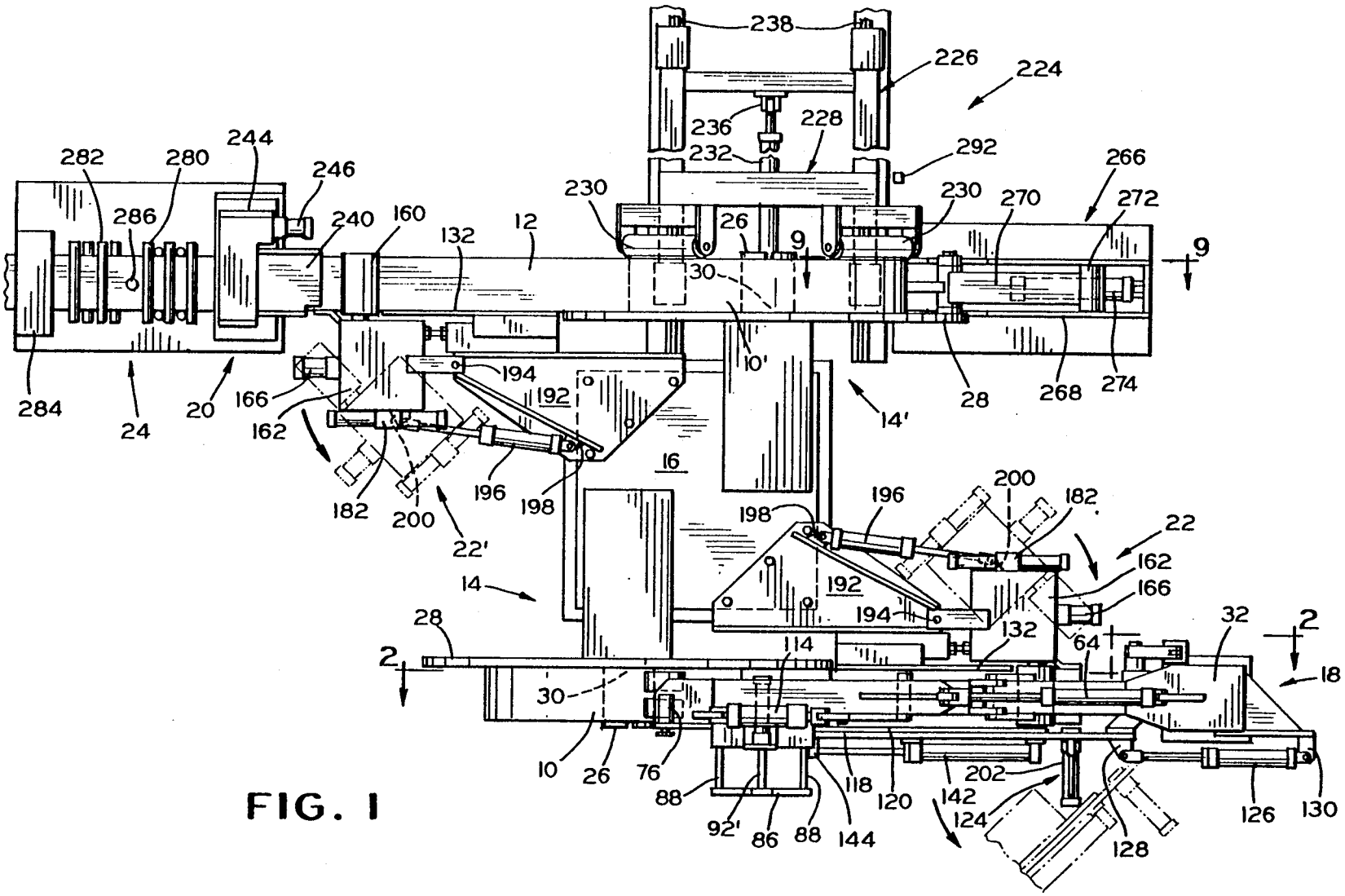
FIG. 1 is a plan view of the uncoiling apparatus according to this invention.

Referring to FIG. 1, there is illustrated an uncoiling apparatus of the present embodiment. Coils 10 and 10' of strip stock 12 are supported by respective ones of a first and second support mechanism 14, 14'.

The support mechanisms 14, 14' are mounted on a turntable 16. As illustrated, the first support mechanism 14 is positioned in the takeoff position adjacent a takeoff mechanism 18 and the second support mechanism 14' is positioned in the feeding position adjacent an aligning mechanism 20. The turntable 16 is rotatable to the end that each of the support mechanisms 14, 14' may be successively positioned in the takeoff position and the feeding position.

The takeoff mechanism 18 uncoils a lead portion of the coil 10 on the first support mechanism 14, to form a leading end of strip 12 for feeding into a pinch roll assembly 22. Pinch roll assemblies 22, 22' are associated with each support mechanisms 14, 14', respectively, and are mounted adjacent the support mechanisms 14, 14' on the turntable 16.

The pinch roll assemblies 22, 22' secure the lead portion of the strip 12 in a predetermined position while the turntable 16 is rotated, moving the first support mechanism 14 from the takeoff position to the feeding position, and the second support mechanism 14' to the takeoff position. In the feeding position, the pinch roll assembly 22' drives the lead portion of the strip 12 into the aligning mechanism 20. The aligning mechanism 20 directs the leading end of the strip 12 into the entrance of a strip processing line 24.

In the strip processing line 24, the leading end of the strip 12 from the coil 10 is butt welded to the trailing end of the strip 12 from the coil 10' which had previously been fed into the strip processing line 24. Thus, a continuous ribbon of stock is fed into the tube forming section of the strip processing line 24. In the strip processing line 24 the stock is progressively formed by suitable forming rolls into the desired tubular shape, with the edges of the stock being brought together and welded, thereby forming a continuous welded tube.

As the continuous tube is being formed, the strip 12 from the coil 10 is fed into the processing line. Simultaneously, a new coil of strip 12 is loaded onto the second support mechanism 14'. The takeoff mechanism 18 is then operated to prepare the strip stock as before.

The support mechanisms 14, 14' are identical, each comprising an arbor 26 with a back plate 28. The arbor 26 is rotatably supported at an inner end 30 as a cantilever. The coils 10, 10' can be mounted on the support mechanisms 14, 14' by advancing the eye of the coil over the arbor 26 while the coil is supported by suitable means, such as an overhead crane, for example. The arbor includes expanding and braking mechanisms of conventional form, and which are therefore not shown.

The arbor back plate 28 extends radially outwardly from the inner end 30 of the arbor 26. The diameter of the back plate 28 is greater than that of the largest coil 10 to be mounted on the support mechanism 14. The back plate 28 acts to guide the strip 12 being removed from the coil 10. The back plate 28 rotates with the arbor 26.

Figure 2:
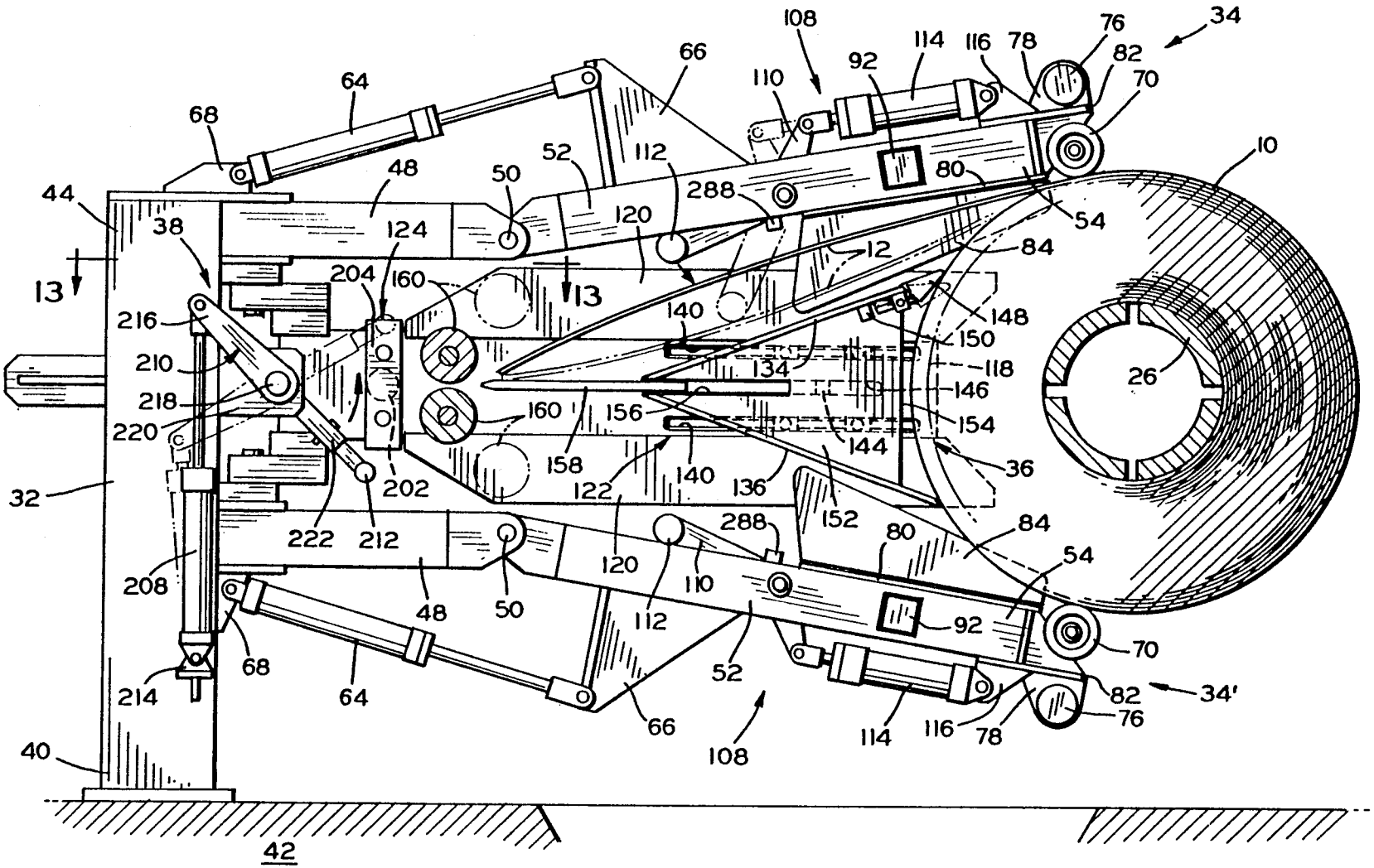
FIG. 2 is an enlarged fragmentary side elevation of the uncoiling apparatus taken substantially along line 2—2 of FIG. 1.
Figure 3:
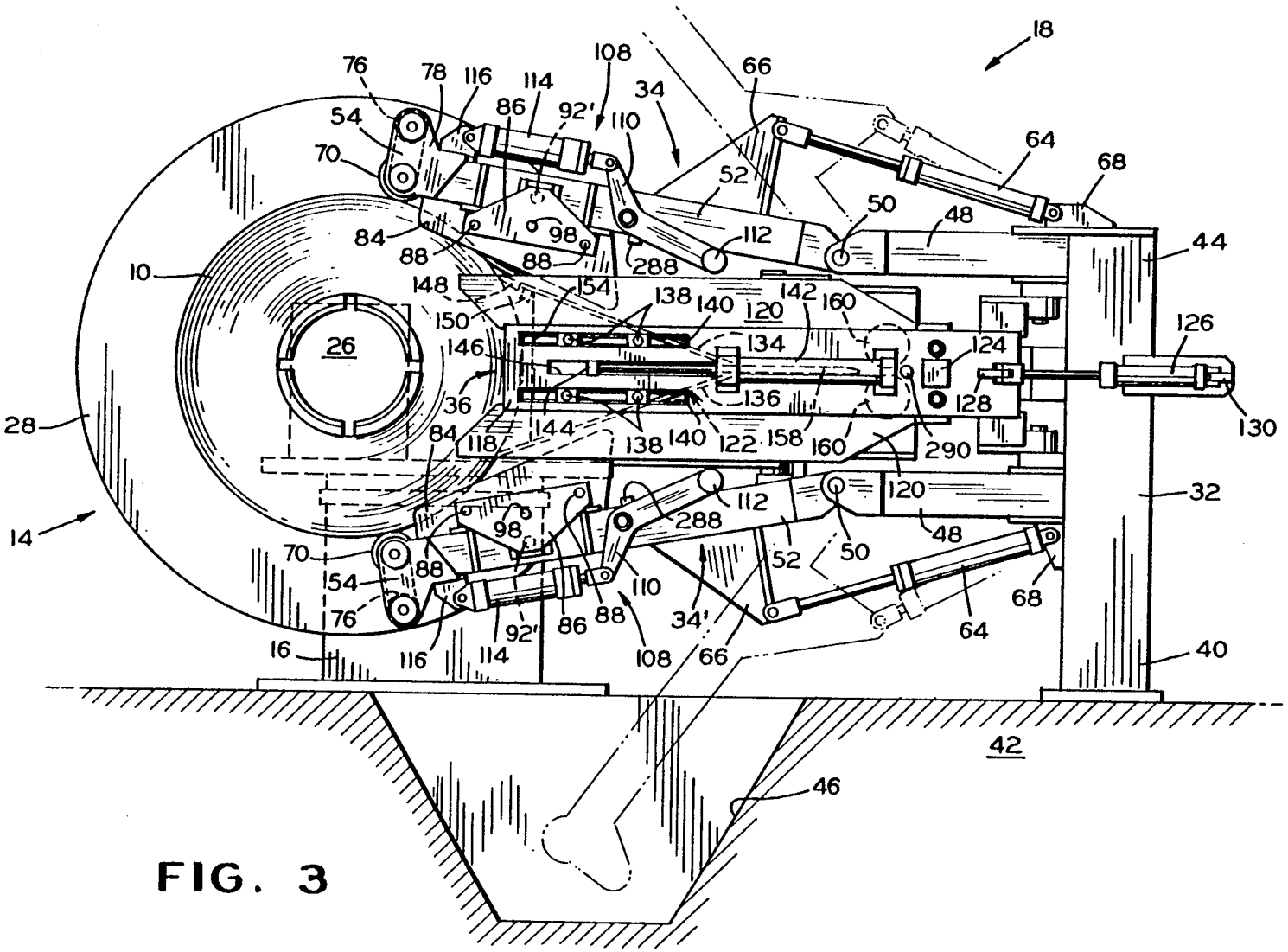
FIG. 3 is an enlarged side elevation of the uncoiling apparatus illustrated in FIG. 2 taken from the opposite side thereof.

As most clearly illustrated in FIGS. 2 and 3, the takeoff mechanism 18 comprises a mounting stanchion 32, an upper and a lower hold-down arm 34 and 34', respectively, a stripper mechanism 36 and a strip straightener 38. The mounting stanchion 32 is an elongate upright member affixed at a lower end 40 to a supporting surface 42 and having a free upper end 44.

Referring to FIGS. 1 and 3, all the component parts of the takeoff mechanism 18 are adapted to swing out of the path of the components mounted on the turntable 16 as the turntable 16 rotates. An exception is the mounting stanchion 32, which is permanently anchored out of the path of the turntable mounted components. A pit 46 is formed in the supporting surface 42, providing a recess into which the lower hold-down arm 34' may swing.

As seen in FIGS. 2 and 3, each hold-down arm 34, 34' comprises a fixed horizontal portion 48, hingedly connected at 50 to a pivotable portion 52. The fixed portion 48 of the upper hold-down arm 34 is suitably affixed as by welding, to the upper end 44 of the mounting stanchion 32, and extends horizontally and generally toward the adjacent support mechanism 14 positioned in the takeoff position. The fixed portion 48 of the lower hold-down arm 34' is fixedly attached, as by welding, to the mounting stanchion 32 intermediate the lower end 40 and the upper end 44, and extends parallel to the fixed portion 48 of the upper hold-down arm 34.

The movable portion 52 of each hold-down arm 34, 34', includes a distal end 54. The end 54 of the upper hold-down arm 34 is disposed to engage the upper portion of the outer periphery of the coil 10. The end 54 of the lower hold-down arm 34 is disposed to engage the lower portion of the outer periphery of the coil 10.

The upper and lower hold-down arms 34, 34' are similar in structure, each being adapted to work upon the coil 10 positioned between the hold-down arms, except that components mounted on the lower hold-down arm 34' are inverted from the position of similar components on the upper hold-down arm 34. Accordingly, only the structure of the upper hold-down arm 34 will be described further.

Figure 5:
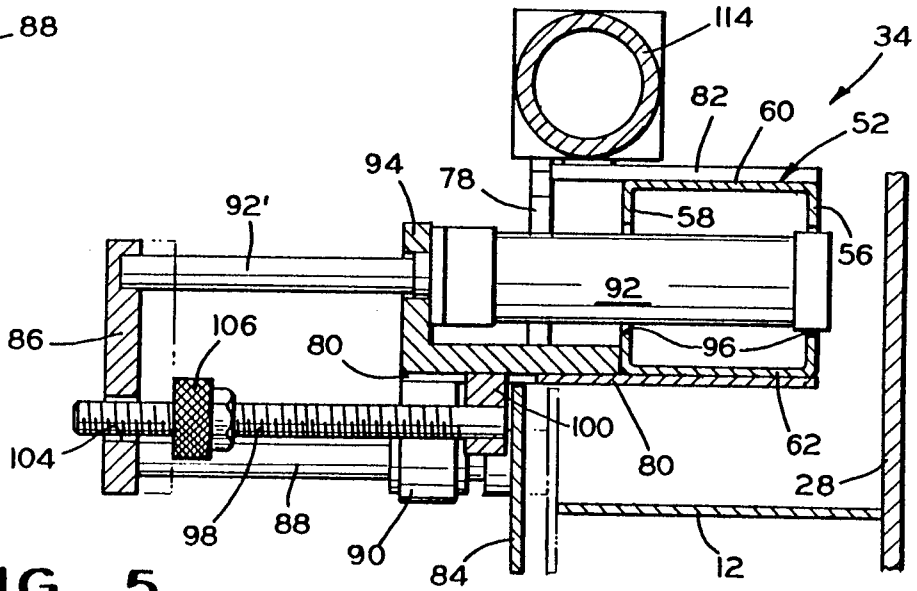
FIG. 5 is a sectional view taken substantially along line 5—5 of FIG. 4.

As most clearly illustrated in FIG. 5, the hold-down arm 34 is generally square in cross section, and includes spaced apart opposed vertical inner and outer walls 56 and 58, respectively. The inner wall 56 faces the turntable 16. The inner and outer walls 56, 58 are joined by spaced apart opposed distal and proximal walls 60, 62, respectively. The proximal wall 62 faces the strip 12 when the hold-down arm 34 engages the coil 10.

Figure 4:
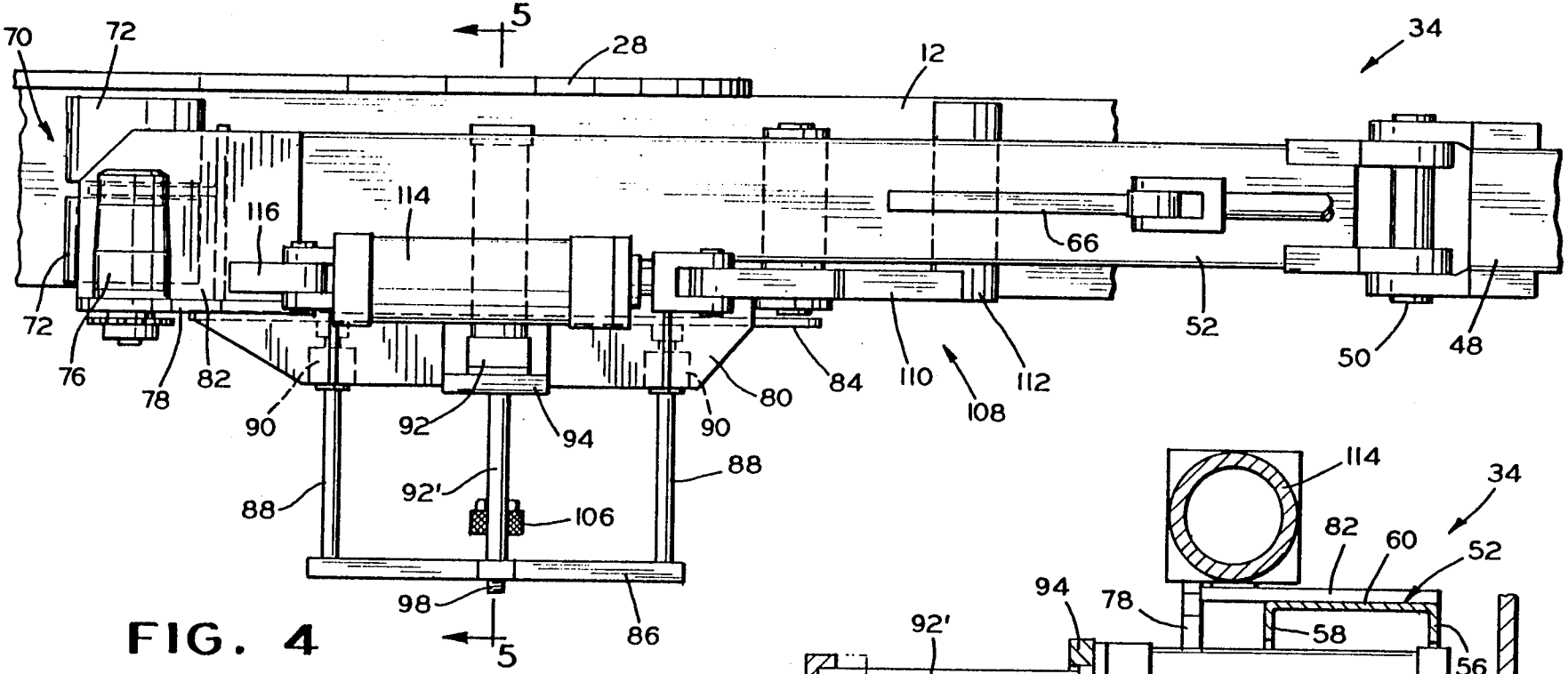
FIG. 4 is a enlarged fragmentary plan view of the upper hold-down arm of the takeoff mechanism illustrated in FIGS. 1 and 2.

A linear actuator 64, clearly illustrated in FIGS. 3 and 4, is attached to the distal wall 60 between an upwardly extending mounting plate 66 on the moveable portion 52 and an anchor point 68 on the fixed portion 48. Extension or contraction of the linear actuator 64 causes the pivotable portion 52 of the hold-down arm 34 to rotate about the pivotal connection 50.

The free end 54 of the hold-down arm 34 is provided with a hold-down mechanism 70, which may comprise two spaced apart rollers 72 rotatably mounted on a common shaft. Each roller 72 preferably includes an outer surface of a material such as neoprene or a suitable equivalent material to provide the rollers with the desired frictional engagement with the coil 10.

In strip 12 with a width significantly less than the length of the hold-down mechanism 70, it has been found that utilizing two spaced apart rollers 72 minimizes the tendency of the strip stock to wander or move laterally from the desired path. The use of two rollers 72 has not been found to impair the handling of wider strip 12. Thus, the use of spaced apart rollers 72 allows the uncoiler to be used with strip 12 in a wide range of widths.

Each hold-down mechanism 70 may be suitably driven by a motor 76 mounted adjacent the hold-down mechanism 70. As illustrated in FIGS. 2, 4, and 5, the motor 76 and the hold-down mechanism 70 cantilever from a vertical mounting plate 78, and are spaced apart from the outer wall 58 of the hold-down arm 34 by horizontally extending plates 80 and 82. The plate 80 is suitably affixed, as by welding, to the proximal wall 62 of the hold-down arm 34, while the plate 82 is similarly affixed to the distal wall 60.

An adjustable guide plate 84 is spaced inwardly from the free end 54, adjacent the proximal wall 62 of the movable portion 52. The guide plate 84 is positionable at selected locations relative to the arbor back plate 28. In operation, the guide plate 84 and the arbor back plate 28 are parallel, and cooperate to define means for guiding the strip 12 as it is stripped from the coil 10.

A follower plate 86 is attached to the guide plate 84 by a pair of guide rods 88. Each guide rod 88 is mounted for axial sliding movement and is guided and supported by a bearing 90 mounted on the lower surface of the horizontally extending plate 80.

The follower plate 86 is positioned by a linear actuator 92, having an extensible arm 92', and mounted on a vertically extending leg of an L shaped bracket 94. The bracket 94 is affixed, as by welding, to the outer wall 58 of the hold-down arm 34. The actuator 92 extends horizontally and the arm 92' is suitably affixed to the follower plate 86. Openings 96 are formed in the inner and outer walls 56, 58 of the hold-down arm 34 to accommodate the body of the actuator 92.

A threaded stud 98 extends from a mounting block 100 (FIG. 5) which is affixed, as by welding, to a bottom face of the L shaped bracket 94. The stud 98 extends through an opening 104 in the follower plate 86. The opening 104 is of larger diameter than the stud 98 to allow the follower plate 86 to be moved freely along the length of the stud 98.

A knurled stop nut 106 is adjustably mounted on the threaded stud 98 and interposed between the follower plate 86 and the hold-down arm 34. The stop nut 106 may be rotated in an appropriate direction to cause the stop nut 106 to advance axially toward or away from the follower plate 86. The stop nut 106 thus limits the travel of the follower plate 86 toward the hold-down arm 34, thereby limiting the travel of the guide plate 84, and allowing the guide plate 84 to be stopped at a selected position.

Referring now to FIG. 2, there is illustrated a condition known as coil set, the tendency for the strip stock to retain an arcuate shape, which may be noted during uncoiling, and may be more severe following extended storage of the coil 10. The arcuate shape will tend to deflect the strip 12 away from the desired path, and may cause it to approach the hold-down arm 34, 34'. If the set is too severe, the strip 12 may not feed reliably into the pinch roll assembly 22.

A strip breaker 108 (FIGS. 2, 3, and 4), comprising a bellcrank arm 110, a roller 112, and a linear actuator 114, provides means to reduce coil set. If severe coil set causes the strip to approach the hold-down arm 34, the strip breaker 108 is actuated to bend the strip 12 away from the hold-down arm, to the position shown in broken lines in FIG. 2. This causes the strip 12 to feed into the pinch roll assembly 22 more horizontally, and thus helps ensure reliable feeding.

The arm 110 is pivotally mounted on the outer wall 58 of the movable portion 52 of the hold-down arm 34, intermediate the adjustable guide plate 84 and the hinged connection 50. The arm 110 is hingedly attached at one end to the linear actuator 114. The roller 112 is affixed as a cantilever to the other end of the arm 110, extending horizontally at right angles to the hold-down arm 34, adjacent the proximal wall 62. The linear actuator 114 is hingedly attached between the arm 110 and an anchor point 116 on the horizontal plate 82.

The stripper mechanism 36 includes a support arm 118 (FIGS. 1 and 3), upon which are mounted a pair of fixed guide plates 120 (FIGS. 1, 2, and 3), a knife assembly 122 (FIG. 2), and a strip positioner 124 (FIGS. 1, 2, and 3). The support arm 118 is pivotally mounted on the mounting stanchion 32, intermediate the fixed portion 48 of the upper and lower hold-down arms 34, 34'. Pivoting movement of the support arm 118 is provided by a linear actuator 126 (FIGS. 1 and 3), which is operatively positioned between a horizontally extending mounting plate 128 on the support arm 118 and an anchor point 130 on the mounting stanchion 32.

The plates 120 are vertically mounted on the surface of the support arm 118 facing the turntable 16. A backing plate 132 (FIG. 1) is vertically mounted on the pinch roll assembly 22, and cooperates with the plates 120 to define guide means for directing the strip 12 into the pinch roll assembly 22.

The knife assembly 122 includes upper and lower blades 134 and 136 adapted to separate or peel the outer layer of strip 12 from the coil 10. Provision of the upper and a lower blades 134, 136 allows the knife 122 to peel the outside layer of strip 12 from either the top or the bottom of the coil, depending upon the direction in which the coil is wound.

The knife assembly 122 is affixed to the support arm 118 by four shoulder bolts 138. Two of the shoulder bolts 138 are slidably received in each of a pair of rabbeted guideways 140 formed in the support arm 118. The knife 122 is thereby adapted to be advanced and retraced relative to the arbor 26 in response to a changing outside diameter of the coil 10, 10'.

Referring now to FIGS. 2 and 3, the knife assembly 122 is positioned by a suitable linear actuator 142. The linear actuator 142 is mounted on the support arm 118, and is connected by means of an attachment member 144 to the knife assembly. The member 144 extends through an elongated slot 146 in the support arm 118 intermediate the rabbeted guideways 140.

As best seen in FIG. 2, the knife assembly 122 includes a proximity arm 148 pivotally attached at the forward end of the upper blade 134 facing the coil 10, 10' when the knife assembly 122 is in operative position. As illustrated, the knife assembly 122 is in the operative position adjacent the coil 10. If the coil 10 were of smaller diameter (shown in broken line), and the knife assembly therefore not in operative position, the arm 148 would be urged downwardly by gravity to the position shown in broken line, out of alignment with the upper blade 134. The arm 148 would thereby be in position to be the first portion of the knife assembly 122 to contact the coil 10, 10' when the knife assembly 122 is advanced to its operating position. Movement of the arm 148 into engagement with the coil pivots the arm upwardly to a position in line with the upper blade 134 and thereby activates an associated sensor 150.

As best seen in FIG. 2, the knife blades 134, 136 are oriented at an acute angle to one another, diverging toward the coil 10. The knife blades 134, 136 are secured to a pair of spaced apart vertical side plates 152 and an associated vertical end plate 154.

The upper and lower knife blades 134, 136 converge to define a horizontal slot 156. An aligned slot is formed to extend into each of the side plates 152. The slot 156 and the aligned slots in the side plates 152 effectively receives a horizontally disposed table 158. The table 158 is a flat plate welded or otherwise suitably affixed to the support arm 118.

As the strip 12 unwinds from the coil 10, it is directed by the table 158 toward the pinch roll assembly 22. The pinch roll assembly serves to hold the strip 12 in a predetermined position as the turntable 16 is rotated, and to drive the lead end of the strip 12 into the strip processing line 24 once the turntable 16 has been indexed. Holding the strip 12 in a predetermined position allows the leading end of the strip 12 to be easily located by the aligning mechanism 20, so that the strip 12 can be automatically guided into the strip processing line 24.

Figure 10:
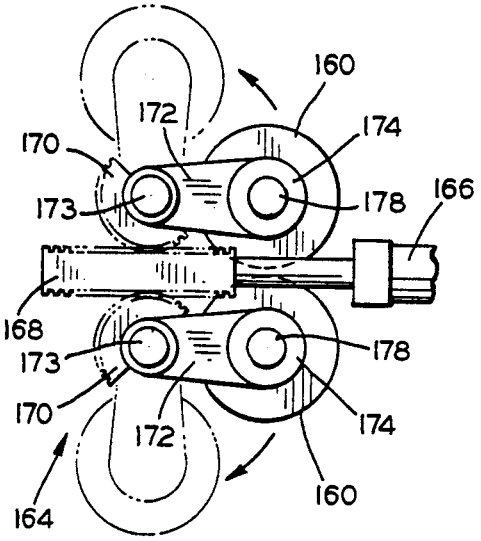
FIG. 10 is a diagrammatic view showing in elevation the mechanism for moving apart the pinch rolls of the pinch roll assembly.
Figure 11:
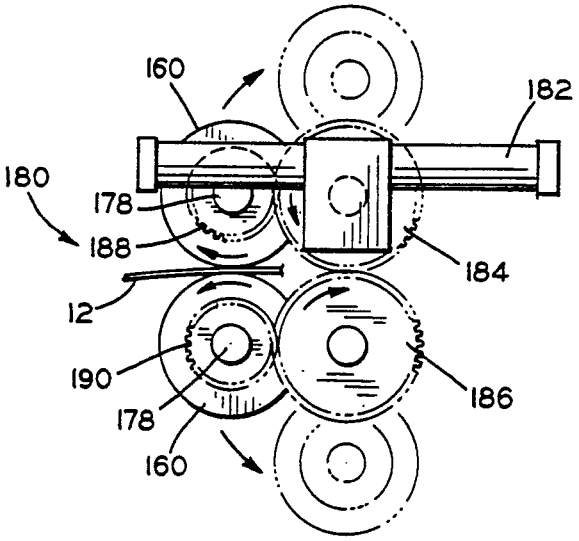
FIG. 11 is a diagrammatic view showing in elevation the mechanism for rotating the pinch rolls of the pinch roll assembly.
Figure 12:
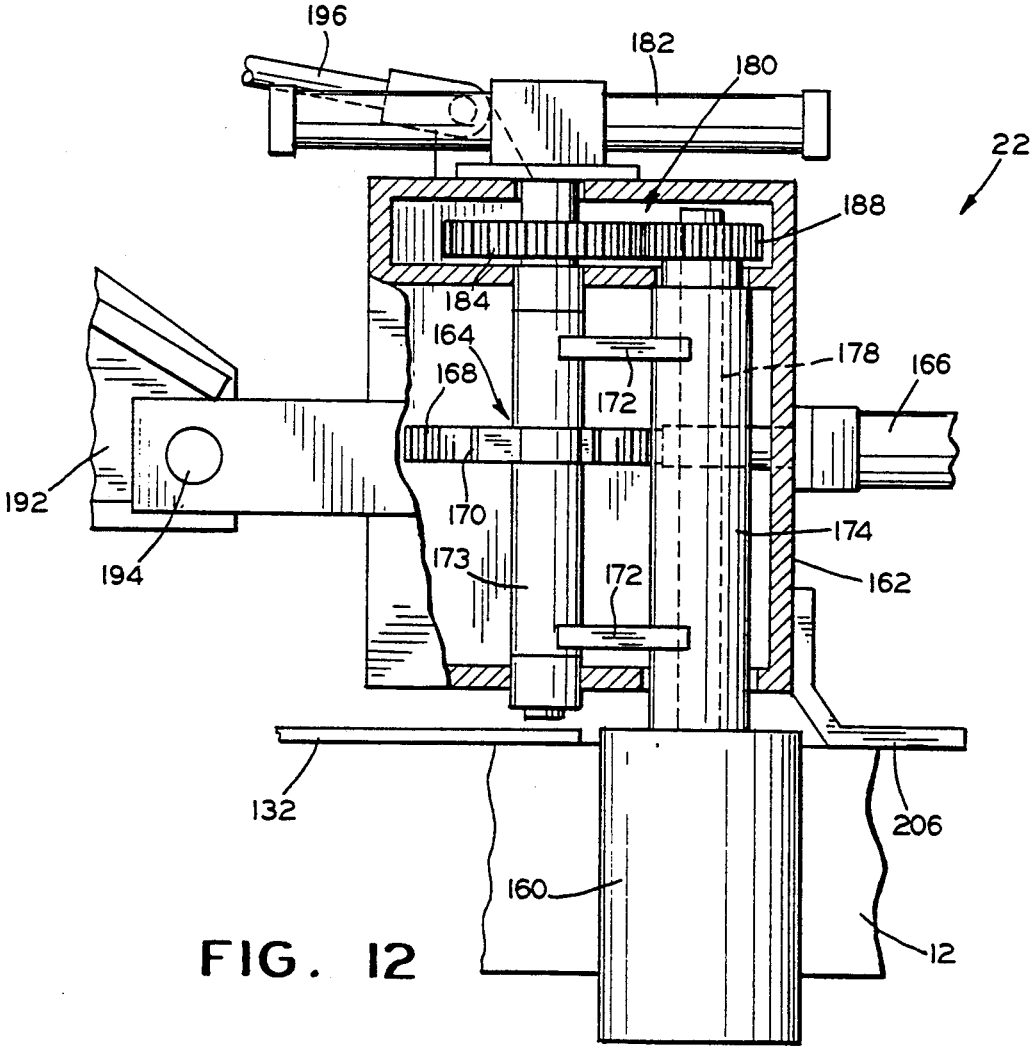
FIG. 12 is an enlarged fragmentary plan view of the pinch roll assembly.

The pinch roll assemblies 22, 22' are similar in structure. Accordingly, only the structure of the pinch roll assembly 22, associated with the first support mechanism 14, will be described in detail. As best seen in FIGS. 10, 11, and 12, the pinch roll assembly 22 includes a pair of horizontally disposed clamp pinch rolls 160, rotatably supported from an upright frame 162. The rolls 160 may be provided with an outer layer of neoprene or other suitable traction-enhancing material.

Gear means, identified generally by reference numeral 164, for adjustably positioning the pinch rolls 160 relative to one another are illustrated in FIGS. 10 and 12. The gear means 164 includes a linear actuator 166 operably connected to a gear rack 168, a pair of pinion gears 170 in driving engagement with the gear rack 168, two pairs of parallel support members 172, each pair of members 172 being fixed at one end to a respective one of a pair of parallel, horizontally extending shafts 173. The shafts 173 are rotatably supported by the frame 162. A pinion gear 170 is fixed to each shaft 173, each shaft 173 thereby pivotally interconnecting a respective one of the pinion gears 170 to a respective pair of members 172. Each pair of members 172 is fixed at the other end to a respective one of a pair of support sleeves 174. Each support sleeve 174 rotatably supports a respective pinch roll 160. The actuator 166 moves the rack 168 axially between the pinion gears 170, to effect simultaneous and opposite rotation of the gears 170. As each gear 170 rotates, the support members 172 pivot the associated support sleeve 174 through a corresponding arc.

Each pinch roll 160 is mounted on an associated shaft 178 which is rotatably received in the respective sleeve 174. When the actuator 166 retracts the rack 168 the sleeves 174, and thus the associated support pinch rolls 160, are moved apart. Conversely, when the rack 168 is extended, the pinch rolls 160 are brought closer together.

The strip 12 is positioned between the pinch rolls 160. When the gear train 164 is actuated to move the pinch rolls 160 together, the strip 12 is clamped and may be prevented from moving. The pinch roll assembly 22 thereby provides holding means for securing the strip 12 in a predetermined position.

Referring now to FIGS. 11 and 12, driving means in the form of a gear train, indicated generally at 180, are provided to rotate the pinch rolls 160. The gear train 180 suitably comprises a hydraulic rotary actuator 182 drivingly coupled to a sun gear 184, an idler gear 186 in driven engagement with the sun gear 184, the pinch roll shafts 178 associated with the upper and lower pinch rolls 160, and upper and lower planet gears 188 and 190 in driven engagement with the gears 184 and 186, respectively.

The rotary actuator 182 is mounted on the opposite side of the frame 162 from the pinch rolls 160. The sun gear 184 is fixed on a shaft driven by the rotary actuator 182. The sun gear 184, in turn, drives the idler gear 186 and the upper planet gear 188. The idler gear 186 drives the lower planet gear 190.

The upper planet gear 188 is fixed to the upper pinch roll shaft 178, on the end opposite the upper pinch roll 160. Similarly, the lower planet gear 190 is fixed to the lower pinch roll shaft 178, opposite the upper pinch roll 160. As indicated by the phantom lines in FIG. 11, the planet gears 188, 190 remain engaged with the sun gear 184 and the idler gear 186, respectively, as the gear train 164 is operated to move the pinch rolls 160 apart. This allows the pinch roll assembly 22 to accommodate a variety of thicknesses of the strip 12.

It will be appreciated that the strip 12 may be driven when clamped between the pinch rolls 160, by rotating the upper and lower pinch rolls 160 in opposite directions. Through the use of the idler gear 186, the planet gears 188, 190, and thus the upper and lower pinch rolls 160, are caused to rotate in opposite directions.

As illustrated in FIGS. 1 and 12, the frame 162 is pivotally attached to a support 192 at 194. The support 192 is suitably affixed to the turntable 16. A linear actuator 196 is pivotally mounted between a bracket 198 fixed on the support structure 192, and a bracket 200 fixed on the frame 162. The frame 162 and the associated pinch rolls 160 may be pivoted by the actuator 196 to the position shown in broken lines in FIG. 1 to cause the pinch rolls 160 to disengage the strip 12.

Figure 13:
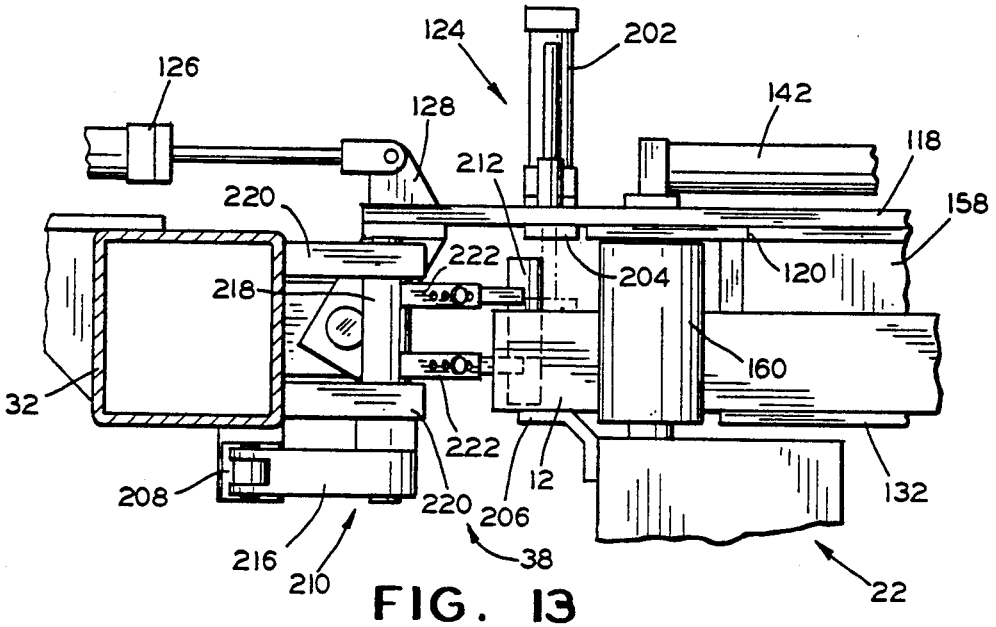
FIG. 13 is a sectional view of the takeoff mechanism taken substantially along the line 13—13 of FIG. 2.

As the strip 12 unwinds, it may tend to drift laterally out of the desired alignment due to variations in manufacture or handling. As illustrated in FIGS. 3 and 13, the strip positioner 124 is mounted horizontally on the support arm 118, perpendicular to the path of the strip 12 feeding out of the pinch roll assembly 22. The positioner 124 includes a linear actuator 202 and an associated ram plate 204. The ram plate 204 is caused to move against the edge of the strip 12, urging the strip 12 horizontally against a bracket 206 mounted on the pinch roll assembly 22.

Means for straightening the leading portion of strip 12 projecting from the pinch rolls 160 is provided by the strip straightener 38. As illustrated in FIGS. 2 and 13, the strip straightener 38 includes a vertically mounted linear actuator 208, a lever arm assembly 210, and a horizontal bar 212. The actuator 208 is pivotally mounted at one end to an anchor bracket 214 on the mounting stanchion 32, and to a lever arm 216 of the lever arm assembly 210 at the other end.

The lever arm assembly 210 includes a cylindrical shaft 218 rotatably received in a pair of spaced apart brackets 220 projecting from the support stanchion 32. The lever arm 216 is fixedly attached to one end of the shaft 218. Two adjustable length arms 222 connect the shaft 218 to the bar 212.

Actuation of the strip straightener 38 causes the arms 222 to move the bar 212 through an arc as illustrated in broken lines in FIG. 2. The strip straightener 38 is effective during a portion of the arc to engage the leading portion of strip 12 projecting from the pinch rolls 160, to thereby bend the strip 12 in the direction of travel of the bar 212 for aligning the leading portion thereof.

Figure 8:
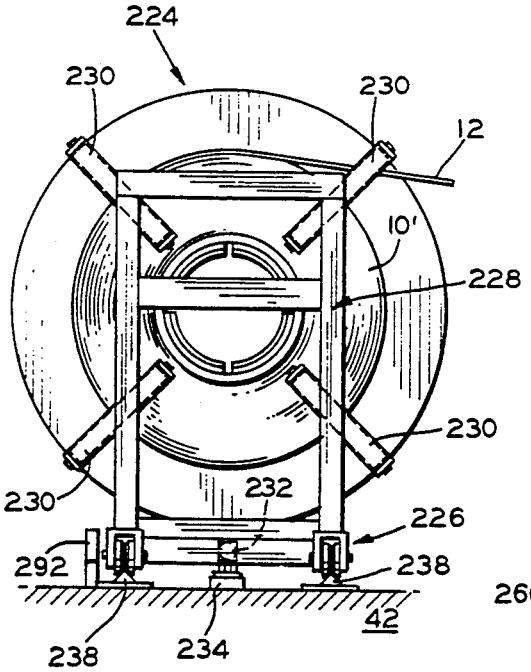
FIG. 8 is a side elevation of the coil retainer illustrated in FIG. 1.

In the feeding position, the coil 10' is retained on the arbor 26 by a conventional coil retainer 224. As seen in FIGS. 1 and 8, the coil retainer 224 includes a wheeled carriage 226 and an upright backstop structure 228, a plurality of radially extending rollers 230 mounted on the structure 228 at spaced intervals around the axis of the arbor 26, and a linear actuator 232. The linear actuator 232 is mounted between an anchor 234 affixed to the supporting surface 42, and a bracket 236 on the carriage 226. Upon actuation of the actuaor 232, the carriage 226 may be caused to move along tracks 238 on the supporting surface 42.

Figure 6:
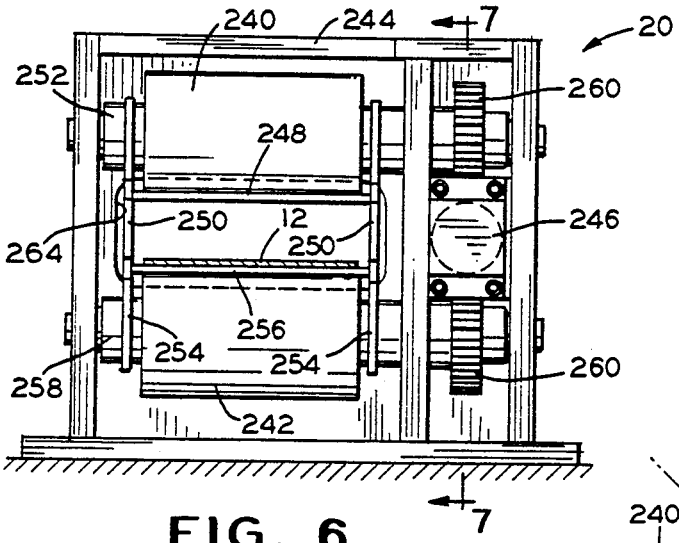
FIG. 6 is a front elevation of the aligning mechanism of FIG. 1.
Figure 7:
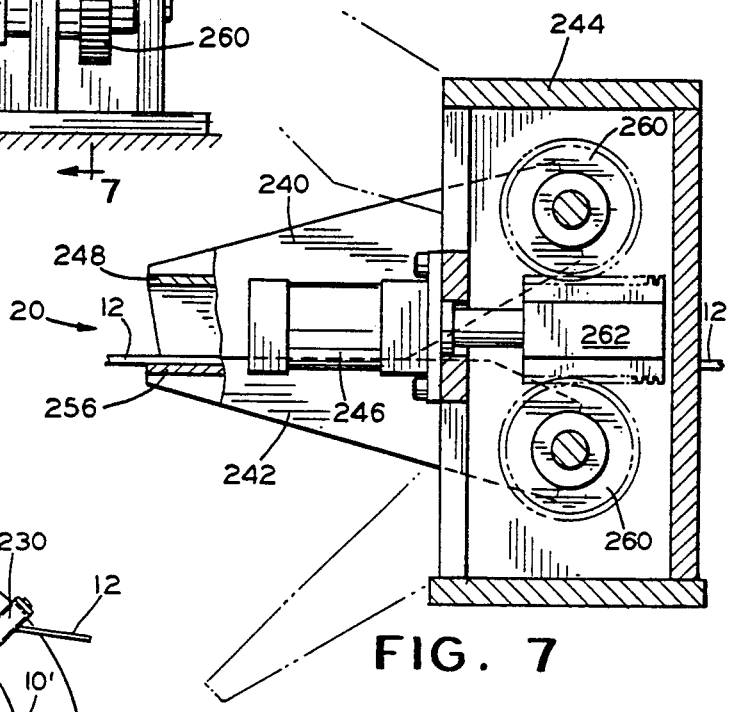
FIG. 7 is a sectional view of the aligning mechanism taken substantially along line 7—7 of FIG. 6.

As illustrated in FIGS. 1, 6, and 7, the aligning mechanism 20 provides means for locating the leading end of the strip 12 extending from the pinch roll assembly 22 after the turntable 16 has been rotated to move the coil to the feeding position. The aligning mechanism 20 is effective to guide the strip 12 into the processing line 24. The aligning mechanism 20 includes upper and lower aligning jaws 240 and 242, respectively, mounted on an upright support 244, and a linear actuator 246.

The upper jaw 240 is formed of a horizontal plate 248 supported between two opposing side walls 250. The side walls 250 are affixed to a first shaft 252 rotatably received within the support 244. The lower jaw 242 is formed of a pair of opposed side walls 254 joined by a horizontally disposed flat plate 256. The side walls 254 are fixed on a second shaft 258 rotatably received in the support 244.

Pinion gears 260 are affixed to the first and second shafts 252 and 258, respectively, and are drivingly engaged by a rack 262 reciprocally movable by the linear actuator 246. The linear actuator 246 is mounted, as by bolting, on the support 244.

In operation, the upper jaw 240 and lower jaw 242 are pivoted away from each other to the position shown in broken lines in FIG. 7, by action of the linear actuator 246 drawing the rack 262 toward the linear actuator 246. Conversely, driving the rack 262 away from the linear actuator 246 causes the first shaft 252 and second shaft 258 to rotate such that the upper and lower jaws 240, 242 are brought together until they meet in a closed position as illustrated in solid lines in FIG. 7.

In this closed position, the upper horizontally disposed plate 248 and side walls 250 of the upper jaw 240 cooperate with the horizontally disposed plate 256 and side walls 254 of the lower jaw 242 to define a rectangular opening in which the strip 12 may be located. An aligned rectangular opening 264 in the support 244 provides for passage of the strip 12 from the opening defined by the upper and lower jaws 240, 242 into the strip processing line 24.

Figure 9:
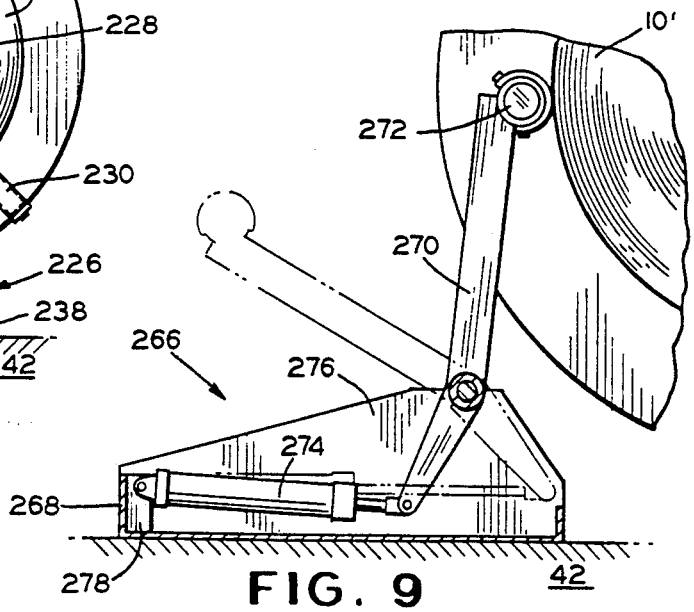
FIG. 9 is a sectional view of the snubber mechanism taken substantially along line 9—9 of FIG. 1.

FIGS. 1 and 9 illustrate a snubber mechanism 266, mounted adjacent the arbor 26 containing the coil 10'. The snubber mechanism 266 provides means for preventing the uncontrolled uncoiling of the coil when in the feeding position.

The snubber 266 more specifically comprises a base frame 268 anchored to the surface 42, a bellcrank arm 270, a cylindrical pressure pad 272, and a linear actuator 274. The bellcrank arm 270 is pivotally mounted at a point intermediate its ends on a flange 276 extending upwardly from and forming a part of the frame 268. The linear actuator 274 is operably mounted between an anchor point 278 on the frame 268 and the lower end of the arm 270. The pressure pad 272 is positioned with its longitudinal axis parallel to the axis of the arbor 26, and is adapted to engage the outer periphery of the coil 10 mounted on the arbor 26 in the feeding position.

The strip processing line 24 is of conventional construction and, as illustrated generally in FIG. 1, includes various aligning and supporting rollers, a pair of driven pinch rollers 280, a flattener 282, and a butt welding station 284. A sensor 286 is provided in the region of the flattener 282 to sense the presence or absence of the strip 12.

Various sensor mechanisms are conventionally provided to detect the presence of the strip 12, and the position of various moveable components of the uncoiling apparatus. In addition to the heretofore mentioned sensor 286 in the flattener 282, and the sensor 150 associated with the knife assembly arm 148 (FIGS. 2 and 3), other sensors which are provided include: a sensor 288 associated with each strip breaker 108 and adapted to sense the presence of the strip 12 adjacent the associated hold-down arm 34 (FIGS. 2 and 3); a sensor 290 to sense the presence of the strip 12 extending from the pinch roll assembly 22 (FIG. 3); a sensor 292 which may be adjusted to limit the travel of the coil retainer 224 toward the coil 10, 10' (FIGS. 1 and 8); and one or more sensors with each linear actuator for detecting the linearly extended position of the actuator.

Figure 14:
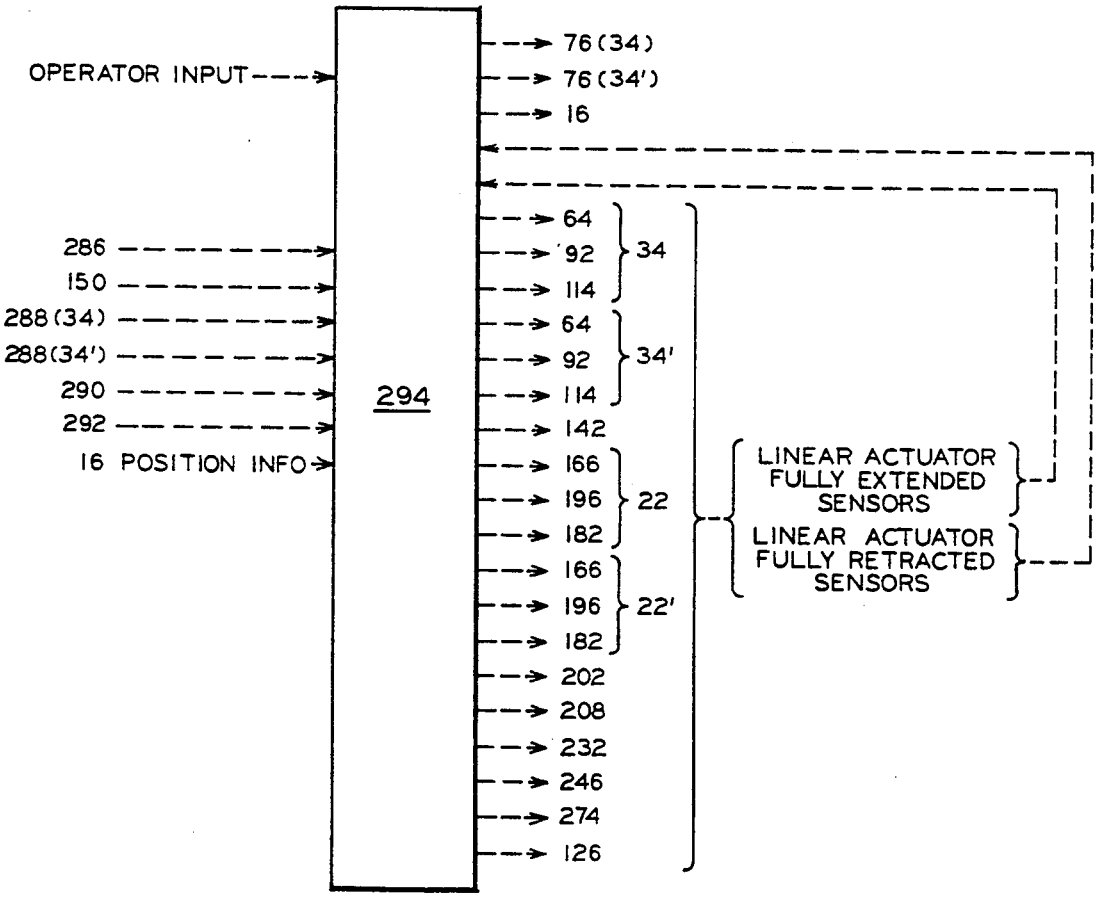
FIG. 14 is a schematic illustration of the automated control mechanism for the uncoiling apparatus.

The signals from the various sensors are directed to an automated control mechanism 294, schematically illustrated in FIG. 14, such as an AutoMax TM distributed control system manufactured by Reliance Electric of Cleveland, Ohio. The control mechanism 294 is shown schematically in FIG. 14. The control mechanism 294 utilizes the various sensor signals to determine the positions of various components and of the strip 12 to operate the various actuators and motors according to a preprogrammed sequence.

Operator input is relied upon to indicate to the control mechanism 294 that the coil 10 is mounted on the support mechanism 14 for a top takeoff or a bottom takeoff. The operator may also manually input commands initiating the automatic uncoiling process, or to interrupt that process if, for example, a problem is observed.

In operation, a coil 10 of strip 12 is loaded by overhead crane onto the arbor 26 of the support mechanism 14. The operator moves the hold-down arms 34, 34' inwardly towards the coil 10 until the hold-down mechanisms 70 contact the coil 10.

Referring to FIGS. 1, 2, and 3, the motors 76 are energized by the operator to operate the rollers 72, rotating the coil 10 until the leading end of strip 12 is positioned at the 9 o'clock position as viewed from the free end of the arm. The operator cuts and removes the shipping bands securing the coil. If the coil 10 is wrapped clockwise around the arbor 26, the coil is positioned for top take-off by rotating it until the leading end of the strip 12 is at the 1 o'clock position. Similarly, if the coil 10 is wrapped counterclockwise around the arbor 26, it is positioned for bottom take-off by rotating the coil until the leading end of strip 12 is positioned at the five o'clock position as viewed from the free end of the arbor 26.

The operator then initiates the automatic sequencing which results in the stripper mechanism support arm 118 being moved into its operating position adjacent the coil 10, and the pinch roll assembly 22 being swung into its operating position. The knife 122 is then advanced towards the coil 10 by the linear actuator 142.

When the proximity arm 148 of the upper blade 134 contacts the coil 10 the arm is urged upwards, actuating the "Stripper Blade on Coil" sensor 150. Upon actuation, the sensor 150 sends a signal stopping movement of the knife 122 towards the coil 10. The coil 10 is automatically rotated by hold-down mechanism 70 to advance the leading end of the strip 12 towards the knife blade 134 or 136 for top take-off or bottom take-off, respectively. The knife blade 134 or 136 peels away the outer layer of strip 12 which is deflected toward the table 158.

As best seen in FIG. 2, if severe coil set causes the strip 12 to come within a preset distance from the sensor 288 associated with the strip breaker 108, the rotation of the coil 10 will be stopped after the strip 12 has advanced for a short distance. The distance the strip 12 advances will place the arcuate shape in the strip 12 beneath the strip breaker 108. The linear actuator 114 is extended to rotate the bellcrank arm 110 and drive the roller 112 into the strip 12, thereby bending the strip 12 toward the knife 122 as illustrated in broken lines in FIG. 2. Thus, coil set is reduced to allow reliable feeding of the strip 12 into the pinch roll assembly 22. The strip breaker 108 then returns to its ready position, and the rotation of the coil 10 resumes.

The leading end of the strip 12 is then directed between the spaced apart pinch rolls 160 until its presence is detected by the sensor 290 (FIG. 3) at the pinch rolls 160, and is halted with the leading end of the strip 12 a short distance beyond the pinch rolls 160.

The strip positioner 124 is actuated by energizing the linear actuator 202 (FIG. 13), causing the ram plate 204 to push the strip 12 into the backing bracket 206.

The pinch rolls 160 are then closed, clamping the strip 12 in place. The strip positioner 124 then moves to its fully retracted position. In the case of top take-off from the coil 10, the portion of the strip 12 protruding from the pinch roll assembly 22 will have a downward-curving arcuate shape. In the case of bottom take-off, it will normally have an upward-curving arcuate shape. The strip straightener 38 will be appropriately oriented with the breaker bar positioned according to the type of take-off anticipated. Thus, the breaker bar 212 will be positioned in a fully downward starting point in the case of top take-off, and in a fully upward starting position for bottom take-off.

The strip straightener 38 is operated through one cycle after the pinch roll assembly 22 has clamped the strip 12 and the strip positioner 124 has retracted. In the case of top take-off, the breaker bar 212 is actuated upward to engage the strip 12, bending it upwardly. The breaker bar 212 should bend the strip 12 enough to cause permanent deformation, straightening the strip 12 extending outwardly from the pinch roll assembly 22 to within desired limits of vertical deviation.

By varying the length of the arms 222, the bar 212 can be made to swing through a greater or lesser distance as the cylindrical member 218 is rotated by the actuator 208. The adjustable arms 222 of the strip straightener 38 are set to the appropriate length based on operating experience with the initial diameter of the coil 10 and the thickness of the strip 12.

After the strip bender 108 has cycled, the support mechanism brake is set to lock the arbor 26 in place. The strip 12 is now ready for feeding into the strip processing line 24.

The linear actuator 142 is operated to retract the knife 122 until an appropriate sensor (not shown) indicates the linear actuator 142 is actuated. The stripper mechanism support arm 118 is swung out of the path of the turntable-mounted components by retracting the linear actuator 126. The movable portion 52 of the upper hold-down arm 34 is lifted out of the rotation path of the turntable-mounted components by retracting the linear actuator 64. Similarly, the lower hold-down arm 34 is lowered into the clearance pit 46 by retracting the linear actuator 64. The strip straightener 38 is out of the path of the turntable-mounted components in its standby position.

When the trailing end of the strip 12 from the coil 10' is fed into the strip processing line 24 and passes through the flattener 282, the strip presence sensor 286 sends an indicative signal to the control mechanism 294. The coil retainer 224 is moved away from the arbor 26 until the linear actuator 232 activates an associated fully-extended sensor (not shown). The jaws of the aligning mechanism 20 open. Since the snubber 266 was fully disengaged prior to feeding of the strip 12 into the processing line, all components are thus out of the path and the turntable 16 is ready for rotation.

The turntable 16 rotates through the appropriate angle to place the coil 10 in the feeding position and the empty arbor 14', which had previously held the coil 10' is placed in the take-off position. The coil retainer 224 advances until it actuates the sensor 292, indicating that it is in position against the coil 10.

The aligning jaws 240, 242 close about the leading end of strip 12 extending from the pinch roll assembly 22. The brake on the support mechanism 14 disengages. The pinch rolls 160 are rotated by the rotary actuator 196 to drive the leading end of strip 12 into the strip processing line 24.

When the leading end has advanced to the flattener 282, the strip presence sensor 286 produces an appropriate signal, and the driven pinch rollers 280 in the strip processing line 24 are moved together. The pinch rolls 160 are then moved apart by the actuator 166. The linear actuator 196 is actuated to retract the pinch roll assembly 22, moving the pinch rolls 160 away from the path of strip 12.

The strip 12 is advanced by the driven rollers 280 to the butt welding station 284 where the leading end is joined to the trailing end of the previous strip 12 from the coil 10'. Once the strip 12 from the coil 10 is joined with the strip 12 from the coil 10', the continuous strip may be fed into the strip processing line 24.

In certain instances, the strip 12 from the coil 10 may not be longitudinally aligned with the previous strip from the coil 10' due to incorrect camber, and must be camber compensated. In camber compensation, the driven rollers 280 are halted and the snubber 266 is engaged. The linear actuator 274 operates to swing pivot arm 270 and bring the pressure pad 272 into contact with the coil 10. With the coil 10 thus restrained from unwinding, the driven pinch rollers 280 and the work rolls of the flattener 282 are moved apart to free the leading end of the strip 12.

An actuator (not shown) in the butt welding station 284 moves the leading end of the strip 12 into longitudinal alignment with the trailing end of the previous strip. The driven pinch rollers 280 are then moved together to re-engage the strip 12. The snubber 266 is disengaged by retracting the pressure pad 272 to its fully disengaged position.

Simultaneously with the feeding of the strip 12 into the strip processing line 24, a third coil of strip 12 may be loaded on the support mechanism 14' in the take-off position. The movable portions 52 of the hold-down arms 34, 34' are then moved to the engage the new coil, the stripper mechanism support arm 118 is swung into its operating position by the actuator 126, and the pinch roll assembly 22 is swung back into its operating position. The strip 12 is then routed to the pinch roll assembly 22 as previously described.

In accordance with the provisions of the patent statutes, the present invention has been described in what is considered to represent its preferred embodiment. However, it should be noted that the invention can be practiced otherwise than as specifically illustrated and described without departing from its spirit or scope. In particular, it may be appreciated that the method and apparatus of the present invention may be utilized in any situation where rapid successive feeding of coiled stock is desired, such as production of seamless gutters.

What is claimed is:

1. Apparatus for preparing successive coils of strip stock for uncoiling and feeding into a strip processing line comprising:

a) at least two coil support means, each coil support means being adapted for rotatably supporting a coil of strip stock for uncoiling;

b) holding means associated with each coil support means, said holding means being adapted to receive a free leading end of the strip stock and hold the leading end in a predetermined position;

c) aligning means adjacent the processing line for receiving the leading end from said holding means and guiding the leading end into the processing line;

d) driving means associated with each holding means, said driving means being adapted to urge the strip stock from said holding means through said aligning means and into the processing line;

e) takeoff means spaced apart from said aligning means, said takeoff means adapted to feed the strip stock from the coil mounted on said coil support means to said holding means; and f) transfer means for successively transferring each coil support means and associated holding means from said takeoff means to said aligning means and back to the takeoff means.

2. The invention of claim 1, wherein said at least two coil support means and said holding means associated with each coil means are mounted on a common transfer means.

3. The invention of claim 1, wherein said transfer means includes a turntable.

4. The invention of claim 1, wherein said takeoff means includes a pivotally mounted support arm.

5. The invention of claim 1, wherein said takeoff means is adapted to selectively feed strip stock to said holding means from a coil wound clockwise and from a coil wound counterclockwise mounted on said coil support means.

6. The invention of claim 5, wherein said takeoff means comprises:

a) means for rotating the coil mounted on said coil support means; and b) a knife including angularly disposed first and second blades, and adapted to peel the free leading end of strip stock from the coil mounted on said coil support means as the coil is rotated.

7. The invention of claim 6, wherein said takeoff means includes means for automatically positioning said knife relative to the coil.

8. The invention of claim 1, wherein said takeoff means includes at least one hold-down arm.

9. The invention of claim 8, wherein each hold-down arm includes means for selectively rotating the coil mounted on said coil support means.

10. The invention of claim 8, wherein each hold-down arm includes means for bending the strip to reduce coil set in the strip stock.

11. The invention of claim 1, including means for guiding the strip stock as it is stripped from the coil.

12. The invention of claim 1, including means for positioning the strip stock in said holding means.

13. The invention of claim 1, wherein said holding means includes a pair of pinch rolls.

14. The invention of claim 13, including:

a) means for pivotally supporting said pinch rolls; and b) means for selectively imparting pivotal movement to said pinch rolls toward and away from each other.

15. The invention of claim 13, including means for rotating said pinch rolls with said pinch rolls spaced apart.

16. The invention of claim 1, including means for automatically controlling said holding means, said aligning means, said driving means, said takeoff means, and said transfer means for operation according to a predetermined sequence.

17. The invention of claim 1, wherein said holding means and said driving means include a pinch roll assembly, said pinch roll assembly comprising:

a) a first and a second pinch roll;

b) a first pivoting member adapted to rotatably support said first pinch roll;

c) a second pivoting member adapted to rotatably support said second pinch roll;

d) a sun gear;

e) means for imparting a rotary movement to said sun gear;

f) a gear train for transmitting rotary movement from said sun gear to each of said pinch rolls;

g) means for imparting a pivotal movement to at least one of said members whereby the distance between said first and second pinch rolls may be varied and said first and second pinch rolls may be rotated at any said varied distance therebetween.

18. The invention of claim 17, wherein said gear train includes an idler gear, whereby said first and second pinch rolls are caused to rotate in opposite directions.

19. The invention of claim 18, wherein said gear train includes a first gear fixed to said first pinch roll and a second gear fixed to said second pinch roll, said first gear meshing with said sun gear, said second gear meshing with said idler gear, and said idler gear meshing with said sun gear.

20. A takeoff mechanism for uncoiling a coil of strip stock, comprising:

a) means for rotating the coil; and b) a knife including angularly disposed first and second blades, said first blade being adapted to peel a free leading end of strip stock from the coil with the coil wound in one direction as the coil is rotated and said second blade being adapted to peel a free leading end of strip stock from the coil with the coil wound in the other direction as the coil is rotated.

21. The invention defined in claim 20, further comprising:

c) a support arm assembly adapted to slidably receive said knife for advancement toward and retraction from the coil; and d) means for positioning said knife relative to the coil.

22. The invention defined in claim 20, further comprising means defining a path for the strip stock as it is removed from the coil.

23. The invention defined in claim 21, further comprising means mounting said support arm assembly for pivotable movement relative to the coil, whereby said knife may be swung away from said path for the strip stock.

24. An apparatus for uncoiling coils of strip stock wound in either direction and feeding the strip stock into a strip processing line, comprising:

a) means for supporting coils successively in a takeoff position and a feeding position;

b) means for uncoiling a leading portion of a coil wound in either direction supported in the takeoff position and holding the uncoiled leading portion in a predetermined position; and c) means for receiving the uncoiled leading portion and propelling strip stock from a coil in the feeding position into the processing line whereby said means for uncoiling a leading portion and said means for propelling strip stock may operate simultaneously.

25. The invention defined in claim 24, further comprising means for preventing the uncontrolled uncoiling of a coil in the feeding position.

26. The invention defined in claim 25, wherein:

a) said means for supporting coils includes a rotatable arbor; and b) said means for preventing the uncontrolled uncoiling of a coil in the feeding position comprises a braking mechanism for said rotatable arbor, a pivoting snubber arm, and means for moving said snubber arm into engagement with the coil in the feeding position whereby uncontrolled uncoiling of the coil may be prevented by moving said snubber arm into engagement with the coil while simultaneously braking the arbor supporting the coil.

27. A method of uncoiling and feeding coils of strip stock successively into a continuous strip processing line, comprising the steps of:

a) positioning a coil of strip stock in a first coil support means;

b) partially uncoiling said coil of strip stock to form a free leading end;

c) guiding said leading end into a selected position in an associated holding means, and securing said leading end in said holding means;

d) moving said first coil support means and respective holding means to a position adjacent the processing line;

e) feeding the leading end from said holding means into the processing line, uncoiling said first coil as it is fed into the processing line;

f) positioning a second coil of strip stock in a second coil support means;

g) partially uncoiling said second coil of strip stock to define a second free leading end;

h) guiding said second leading end into a selected position in an associated holding means;

i) securing said second leading end in said associated holding means; and j) moving said second coil support means and respective holding means to said position adjacent the processing line and returning said first coil support means to its original position and repeating steps a) through i).

28. A method of uncoiling and feeding coils of strip stock according to claim 27, wherein at least steps f) and g) are performed simultaneously with step e).

29. A method of uncoiling and feeding coils of strip stock according to claim 27, wherein steps f) through i) are performed simultaneously with step e).

* * * * *